United States Patent [19]

Buuck et al.

[11] 4,221,199

[45] Sep. 9, 1980

[54] PLURAL LASH ENGINE VALVE GEAR AND DEVICE FOR SELECTING SAME

[75] Inventors: Bryce A. Buuck; William T. Mihalic; David P. Clark, all of Battle Creek, Mich.

[73] Assignee: Eaton Corporation, Cleveland, Ohio

[21] Appl. No.: 805,687

[22] Filed: Jun. 13, 1977

[51] Int. Cl.[2] ..... F02D 13/06

[52] U.S. Cl. ..... 123/90.16; 123/90.43; 123/198 F

[58] Field of Search ..... 123/198 F, 90.15, 90.16, 123/90.17, 90.27, 90.28, 90.29, 90.52, 90.42, 90.43, 90.45

[56] References Cited

U.S. PATENT DOCUMENTS

| | | | |
|---|---|---|---|
| 2,934,052 | 4/1960 | Longenecker | 123/90.16 |
| 2,997,991 | 8/1961 | Roan | 123/90.16 |
| 3,166,057 | 1/1965 | Konrad et al. | 123/90.16 |
| 3,277,874 | 10/1966 | Wagner | 123/90.16 |
| 3,413,965 | 12/1968 | Gauasso | 123/90.16 |
| 3,422,803 | 1/1969 | Stivender | 123/90.16 |
| 3,786,792 | 1/1974 | Pelizzoni et al. | 123/90.16 |
| 3,964,455 | 6/1976 | Brown | 123/90.16 |

*Primary Examiner*—Ira S. Lazarus

*Attorney, Agent, or Firm*—R. J. McCloskey; R. A. Johnston

[57] ABSTRACT

A means for selecting one of a plurality of predetermined amounts of the lost-motion lash in the valve gear of an engine while the engine is running. A latchable mechanism in the valve gear is movable from a first position providing predetermined normal low level lash to a second position providing a predetermined substantially greater lash for reducing the effective lift of the cam and shortening of the valve event. A unique cam profile provides a period of linear lift of substantially constant low velocity, both during lash take-up on valve opening to prevent high velocity clash of valve gear components and during valve closing to prevent high velocity seating of the valve.

4 Claims, 13 Drawing Figures

POSITIVE VELOCITY
NEGATIVE VELOCITY
LIFT
ACCELERATION
LIFT (IN)
VELOCITY *10**2 (IN/DEG)
ACCELERATION *10**3 (IN/DEG/DEG)
CAM ANGLE (DEGREES)

POSITIVE VELOCITY
NEGATIVE VELOCITY
LIFT
ACCELERATION
LIFT (IN)
VELOCITY *10**2 (IN/DEG)
ACCELERATION *10**3 (IN/DEG/DEG)
CAM ANGLE (DEGREES)

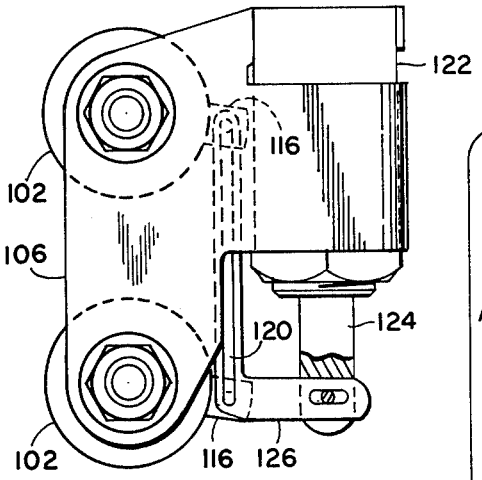
FIG. 11
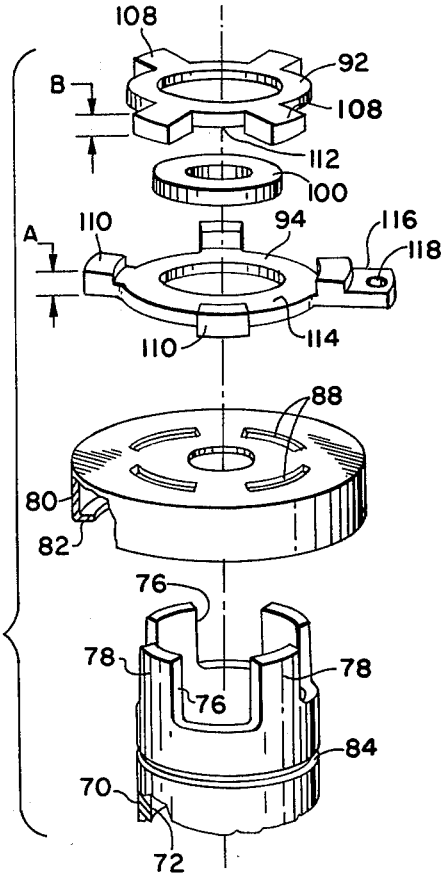
FIG. 12
FIG. 13
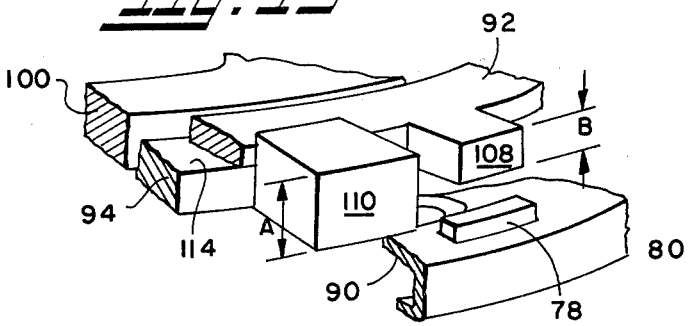

PLURAL LASH ENGINE VALVE GEAR AND DEVICE FOR SELECTING SAME

BACKGROUND OF THE INVENTION

The present invention relates to the timing and amount of opening and closing of the combustion chamber valves of an internal combustion engine.

In the design of four-cycle internal combustion engines, it has been found desirable, when the engine is under load, for proper scavenging to provide a certain amount of overlap of the opening and closing of the intake and exhaust valves during each combustion chamber cycle. In engines of the type having a lobed cam timed for rotation with respect to the engine output shaft, the lobes of the cam are configured in shape and radial height so as to impart to an associated cam follower in the valve gear the appropriate motion and driving force for opening and closing of the intake and exhaust valves in accordance with a predetermined schedule of motion versus cam rotational position. It is known to design the cam lobes such that a certain amount of overlapping occurs between the closing of the exhaust valve upon termination of one combustion chamber cycle and the opening of the intake valve for beginning of the next complete cycle of the combustion chamber.

Previously it has been shown that the amount of opening and, to some degree, the timing of the combustion chamber valve may be altered by changing the length of the driving members in the engine valve gear between the cam and the valve while the engine is running. Such a known device is shown in Volume 50, No. 8 of the Society of Automotive Engineers Journal (TRANSACTIONS), August 1942 at page 69 in FIG. 28 thereof, in an article entitled "VALVE GEAR RESEARCH AS APPLIED TO DIESEL ENGINES" by Carl Voorhies. The technique of collapsing a hydraulic lash adjusting tappet is employed to change the length of the valve gear by selectively controlling flow of pressurized oil to the hydraulic tappet. The Voorhies device has been applied in combination with secondary lobes opposite the main lift lobe of a cam to alter the opening and timing of the exhaust valve of an engine for providing improved engine compression action braking in the motoring mode. See, for example, U.S. Pat. No. 3,786,792 of W. J. Pelizzoni et al. which teaches the use of a collapsible hydraulic tappet to render operative or inoperative a seondary cam profile useful for changing the exhaust valve timing to provide for engine braking.

It is known to use a two-stage latchable device (while the engine is running) for completely or partially disabling and re-enabling the intake and exhaust valves of an engine. See, for example, U.S. patent application Ser. No. 578,295 filed May 16, 1975 to Michael M. Walsh, and U.S. patent application Ser. No. 627,424 filed Nov. 30, 1975 to Martin W. Uitvlugt, which applications have been assigned to the assignee of the present invention. The latchable devices of Walsh and Uitvlugt utilize a rotary latch mechanism which, in one position, permits the lugs on a fulcrum member to move freely into recesses or slots when the fulcrum member is lifted by action of the cam lobe to thus absorb, by lost motion, the driving forces of the cam. The known latch has a second position in which the lugs register against other reactive members to transmit the driving forces of the cam and provide for normal opening and closing of the associated engine valve.

In an effort to reduce the fuel consumption and improve the smoothness of an engine running at idle or part-load, it has been proposed to reduce the normal opening and closing of the valves and to alter the timing such that overlap between the closing of the exhaust valve and the opening of the intake valve is reduced or eliminated. In order to accomplish this change in the valve lift and timing while the engine is running, it has been proposed to provide for selectively increasing the lost motion lash in the valve gear, thereby effectively reducing the lift height of the cam lobe and also reducing the period of time during which the valve is open. However, it has been found that, if the normal lost motion lash in an engine valve gear is suddenly increased substantially, that is, by an amount approximately six to ten times the normal lash, the members of the valve gear have acquired prohibitively high velocities at the instant the lash is taken up and the valve begins to move from its seat. With such increased lash present in the valve gear train, the valve is moving at a prohibitively high velocity when the valve contacts the valve seat and the driving forces are relaxed, lash recurs for any given cam profile suitable for opening and closing of valves with a normal low amount of lash.

SUMMARY OF THE INVENTION

The present invention provides a solution to the abovedescribed problem of providing for a means of reducing the amount of lift and the period of time in which the combustion chamber valves of an engine are open to thus reduce valve timing overlap by selectively increasing, while the engine is running, the amount of lost motion lash in the engine valve gear train between the cam and the combustion chamber valve. The present invention employs a two-stage latchable means movable between a first position providing for a normal low level of lost motion lash in the valve gear and a second position providing for a substantially greater amount of lost motion lash in the valve gear. The latchable means of the present invention employs a latchable mechanism having first and second registration surfaces spaced apart by a predetermined amount corresponding to the desired normal lash of the valve gear, when the valve gear driving forces are relaxed, the registration surfaces being in driving contact when the valve gear driving forces are reapplied. When the latch means is in a second or latched position, a third registration surface is spaced apart from the first registration surface by a predetermined amount greater than the normal lash, when the valve gear driving forces are relaxed. The first and third registration surfaces are in driving contact when the valve gear driving forces are reapplied, to provide a reduced amount of opening and shorter valve opening period.

The present invention incorporates a unique cam configuration or profile which provides for a period of substantially linear valve lift at a relatively low level and constant velocity, which period occurs during the time in which the second stage or greater lash is terminated on valve opening and also when the valve is seating and the second stage lash begins to recur. The present invention thus provides for a unique means of selecting one of a plurality of predetermined amounts of lost motion lash in the valve gear of an engine while the engine is running, to thereby alter the amount and duration of valve opening and yet prevents damage to the engine valve gear and valves by eliminating high velocity contact of the valve gear members or high velocity seating of the valve during onset and termination of the valve gear driving forces as the lash is taken up and recurs.

BRIEF DESCRIPTION OF THE DRAWINGS

FIG. 11 is a top view of an embodiment of FIG. 10;

FIG. 12 is a perspective view of an exploded assembly of embodiment of FIG. 10; and FIG. 13 is a partial perspective view similar to FIG. 12 showing the fulcrum lugs received in the retainer slots with the latching means in the low level lash position.

DETAILED DESCRIPTION

Figure 3:
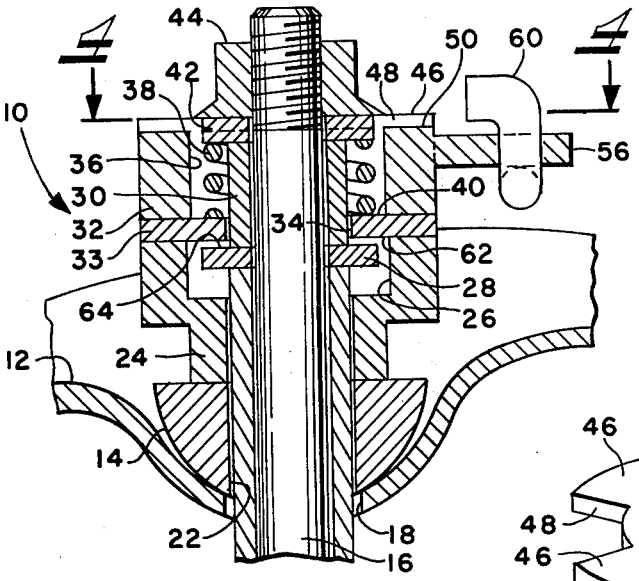
FIG. 3 is a partial cross section taken through the rocker arm mounting stud of overhead valve gear for an engine employing the present invention.

With reference to FIG. 3, one embodiment, indicated generally at 10, of the present invention is illustrated as incorporated into the overhead valve gear of an engine of the type having rocker arms 12 individually pivoted about a fulcrum 14 in which are mounted on the cylinder head of the engine by means of a stud 16 received through an aperture 18 formed in the rocker. In FIG. 3 the conventional pushrod and valve stem connections at opposite ends of the rocker arm have been omitted for sake of brevity. However, in the illustration of FIG. 3, the rocker arm is to be considered as biased upward against the fulcrum 14 under the forces of the pushrod from the cam follower acting on the left end of the rocker arm and the resistance of the valve stem under the urging of its return spring acting on the right end of the rocker arm.

A spacer sleeve 20 is received over the stud 16 and through the rocker aperture 18 with the fulcrum 14 having a central aperture 22 slidably received over the spacer 20. A collar 24 for axial force transmission is received over the sleeve 20 with the lower axial end thereof in FIG. 3 in abutment with the upper axial face of fulcrum 14. The collar 24 has a counterbore 26 provided in the upper end thereof for clearance of associated components and for axial registration against the bottom thereof. A lower stop washer 28 is received over the mounting stud 16 and registers axially against the upper end of the sleeve 20. A precision spacer sleeve 30, having a precisely controlled axial length, is received over the mounting stud 16 and registers axially against the upper face of the lower stop 28. A washer 33, having a central aperture 34 provided therein, is received over the precision spacer 30 in a slip fitting arrangement, and rests against the upper surface of collar 24. A spring 38 is received over spacer 30 and registers against the upper surface 40 of washer 33, and a stop plate 42 is received over the mounting stud 16 in a closely fitting relationship. A latching spacer 32, having inner periphery 36, is received over spring 38 in slip-fitting arrangement and rests against surface 40 of washer 33. The greatest thickness of latching spacer 32 plus the thickness of washer 33 is less than the thickness of precision spacer 30 by a small amount, about 0.002 inches (0.05 millimeters), to allow free rotation of latching spacer 32. The stop plate 42 is retained in axial registration against the precision spacer 30 by any suitable retaining means as, for example, nut 44 threadedly engaged over the end of mounting stud 16. The nut 44 is torqued sufficiently to compress stop plate 42, precision spacer 30, lower stop 28, and spacer sleeve 20 in axial registration against portions of the engine cylinder head (not shown); and frictional engagement therebetween is thus provided sufficient to prevent rotation of these components about stud 16. Spring 38 is thus compressed between the undersurface of stop plate 42 and surface 40 to urge the washer 33 in a downward direction.

Referring now to FIGS. 3 through 9, the stop plate 42 has a plurality, and preferably four, radial arms 46 extending outwardly from a central hub region with the arms 46 defining peripherally therebetween a plurality of recesses 48.

Figure 6:
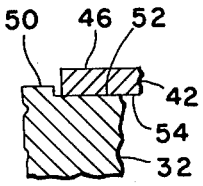
FIG. 6 is a portion of a section view taken along section indicating lines 6—6 of FIG. 4.

The latching spacer 32 has, on the upper axial face thereof, a plurality of lugs 50 extending axially upward from the upper face 52 of the spacer 32. The lugs 50 correspond in number to the number of recesses 48 provided in stop plate 42 and have an axial height determined by the amount of additional lost motion lash that is desired to be added to the valve gear train which, in the presently preferred practice, is 0.030 inches (0.75 millimeters). The circumferential width of the lugs 50 is sufficiently less than the circumferential width of recesses 48 in stop plate 42 so as to permit nesting of the lugs 50 between the lugs 46 of the stop plate when the spacer lugs 50 are aligned with the recesses 48 in the stop plate. The thickness of the stop plate 42 is greater than the axial height of lugs 50, as shown in FIG. 3 and FIG. 6, such that, when the lugs 50 are nested in the recesses 48 as shown in FIG. 6, the upper axial face 52 of the latching spacer registers against the undersurface 54 of the stop plate 42.

Figure 4:
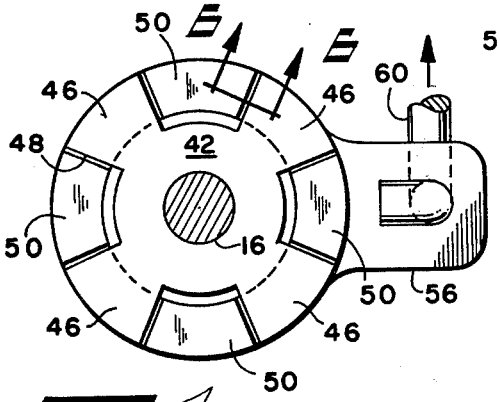
FIG. 4 is a section view taken along section indicating lines 4—4 of FIG. 3.
Figure 9:
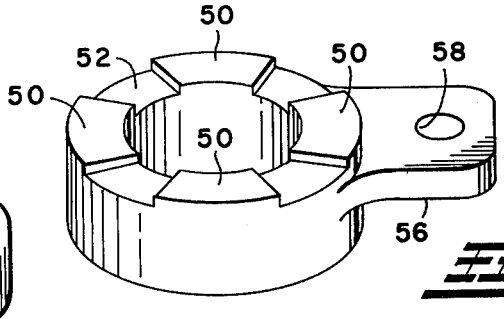
FIG. 9 is a perspective view of the rotatable latch member of the embodiment of FIG. 3.

The latching spacer 32 has a radial arm 56 extending outwardly from the outer diameter thereof with the arm having an aperture 58 provided therethrough for attachment of a suitable actuator as, for example, rod 60. Application of a force in the longitudinal direction of rod 60 will thus be effective to cause rotation of the latching spacer 32 about spring 38, provided that the rocker arm 14 of FIG. 3 does not exert sufficient force upon fulcrum 14 to cause driving collar 24 to push the latching spacer 32 axially upward resulting in nesting or engagement of the spacer lugs 50 with the recesses 48 in stop plate 42. With reference to FIG. 3 and FIG. 4, the spacer 32 is shown in a position with the lugs 50 nested between grooves 48 of stop plate 42 under the urging of upward forces applied by rocker arm 12, which forces are sufficient to overcome the bias and compress the spring 38.

Figure 7:
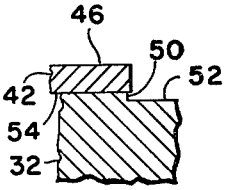
FIG. 7 is a partial section view taken along section indicating lines 7—7 of FIG. 5.
Figure 8:
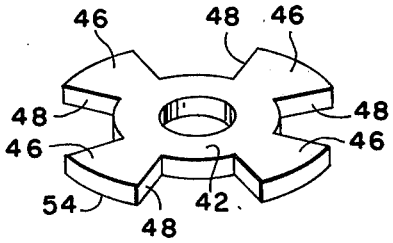
FIG. 8 is a perspective view of the slotted stop plate of the embodiment of FIG. 3.
Figure 5:
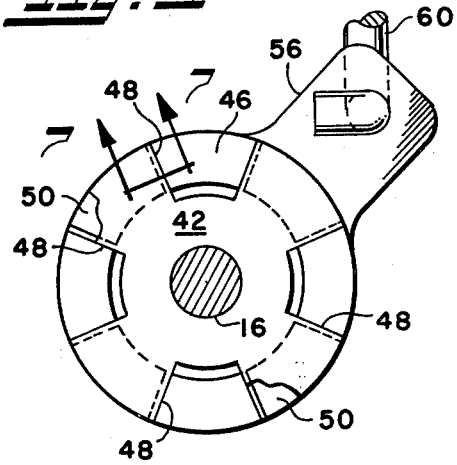
FIG. 5 is a view similar to FIG. 4 showing the mechanism in the alternate position.

With reference to FIGS. 3, 5 and 7, the latching spacer 32 is shown in its alternate, or unlatched, position as indicated by the rotation of the arm 56 by an angle of approximately 45°, as illustrated in FIG. 5. In operation, a tension force F is applied to the actuator rod 60 when the latching spacer is in the position of FIG. 4; however, because of the nesting of lugs 50 in the recesses 48 of stop plate 42, the latching spacer 32 is unable to rotate. The forces from rocker arm 12 maintain the latching spacer 32 biased in an upward direction to maintain the nesting as shown in FIG. 6. As the valve gear driving forces are cyclically relaxed on rocker arm 12, the compression spring 38 is operative to bias the washer 33 in a downward direction until the undersurface 62 (see FIG. 3) of washer 33 registers against the upper face 64 of the washer 28. With the latching spacer 32 registered against washer 33, the lugs 50 on the latching spacer are no longer in engagement with the recesses 48 of stop plate 42, and the latching spacer 32 is rotated by the actuating rod force F to the position shown in FIGS. 5 and 7. In the position shown in FIGS. 5 and 7, the latching spacer 32 has the upper surface of lugs 50 disposed directly beneath the undersurface 54 of lugs 46 on stop plate 42. Upon reapplication of the cyclic valve gear driving forces to rocker arm 12, the reaction thereof against fulcrum 14 and driving collar 24 and washer 33 urge the latching spacer 32 causing the lugs 50 to register against the undersurface 54 of the stop plate as shown in FIG. 7, thus causing the fulcrum 14 to be located at a position vertically downward by an amount equal to the height of lugs 50, as compared to the position of fulcrum 14 when the latching collar 32 is in the position shown in FIG. 4. It will be apparent that, upon reversing the direction of the force F on actuator rod 60, and upon subsequent relaxation of the valve gear driving forces, the latching spacer 32 will be rotated and retured to the position shown in FIG. 4 to again permit nesting of lugs 50 in the recesses 48 of the stop plate.

It will be understood by those having ordinary skill in the art that, where hydraulic lash adjusting tappets (not shown) are employed in the valve gear train between the camshaft and the rocker arm 12, it will be necessary to prevent the hydraulic lash adjusting device from taking up the increased lash of the valve gear train brought about by permitting fulcrum 14 to move upward by the distance corresponding to the height of lugs 50 when the latching spacer 32 is in the position shown in FIG. 4. In order that the hydraulic lash adjuster will not compensate for the increased length in the valve gear train, the compression spring 38 is provided with a sufficiently high spring constant so as to maintain adequate reactionary forces on the rocker arm 12 to prevent the plunger return spring in the hydraulic lash adjuster from taking up the additional lash added to the valve gear train.

Figure 10:
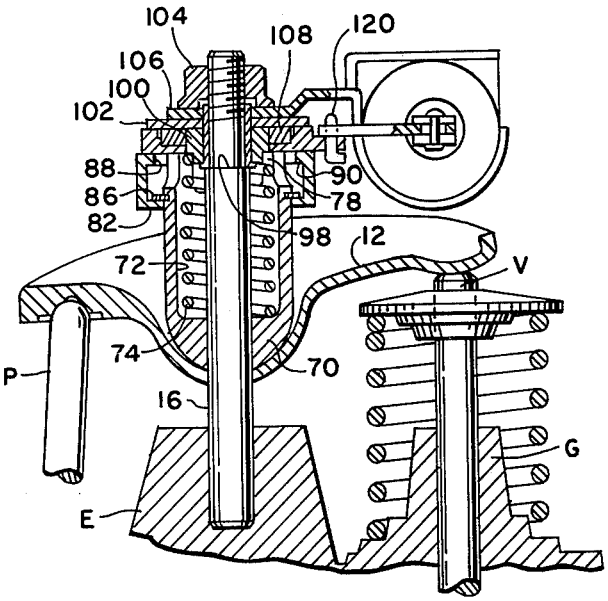
FIG. 10 is a cross section through rocker arm mounting stud of an engine showing an alternative embodiment of the present invention.

Referring now to FIGS. 10, 11, 12 and 13, an alternate embodiment of the invention is illustrated in which the rocker arm 12 is shown received over the mounting stud 16 which is attached to the cylinder head of the engine denoted by the letter "E" in FIG. 10. The left end of rocker arm 12 in FIG. 10 pivotally engages a conventional pushrod denoted "P", and the right end of the rocker arm 12 has a pivot surface contacting the end of a combustion chamber valve stem "V" extending from a valve guide "G," thus providing a conventional pushrod type overhead engine valve gear.

It will be understood that the pushrod "P" is actuated by a suitable cam follower or tappet driven by a conventional rotating camshaft, which tappet and camshaft have been omitted in FIG. 10 for brevity. The rocker arm 12 pivotally contacts a fulcrum 70 which is slidably received over the stud 16 for movement in a vertical direction with respect thereto. The fulcrum 70 has a counterbore 72 provided therein in which a compression spring 74 registers against the bottom of the counterbore for urging the fulcrum 70 in a downward direction, thereby maintaining contact of the fulcrum with the rocker arm 12. With reference to FIGS. 10 and 12 the upper end of the fulcrum 70 has the wall thereof formed by counterbore 70 provided with a plurality, and preferably four, notches 76 which form therebetween a plurality of axial tabs 78.

Referring to FIG. 10, a spring retainer 80 having a generally circular cup shape is received over stud 16 with the open end disposed downward and turned inward to form a lip 82. A circumferential groove 84 is provided in the outer periphery of the fulcrum member 70 and a retaining ring 86 is received in the groove 84. A plurality of circumferentially spaced slots 88, corresponding in number to the number of tabs 78, are provided in the closed end of the spring retainer 80, the slots 88 having a radial width and arcuate configuration conforming to, and sized to, provide clearance for the ends of the tab 78. When the retainer 80 is received over stud 16, the tabs 78 on fulcrum 70 are received in, and protrude through, the slots 88 in retainer 80 when same is held onto the fulcrum by retaining ring 86 with the spring 74 being compressed between the under surface 90 of the spring retainer and the bottom of counterbore 72.

An upper and lower latching ring, respectively denoted 92 and 94, are rotatably received over stud 16 with an optional intermediate bearing sleeve 96 registering axially on a shoulder 98 provided on the mounting stud 16. The inner periphery of the rings 92, 94 are sized so as to have received therein in slip fitting arrangement a spacer ring 100 which has the axial thickness thereof precisely controlled to a dimension greater than the combined axial thickness of the central positions latching rings 92, 94 when the central portions thereof are in axial registration so as to permit freedom of rotation of the latching rings. A stop plate 102 is received over the stud 16 (and sleeve 96 if used), the stop plate being retained on the assembly by suitable fastening means such as nut 104 threadedly received over stud 16. Referring to FIG. 10, the nut is torqued sufficiently to cause axial registration of undersurface 90 of the spring retainer against the shoulder 98 (and optionally a flange on the bearing sleeve 96 if used), the axial spacer 100, the stop plate 102 and a mounting bracket 106 for an associated actuator mechanism.

Referring to FIGS. 12 and 13, the upper latching plate 92 has a plurality, preferably four, circumferentially spaced radially extending lugs 108 provided thereon with the lugs extending downwardly to have a predetermined thickness, denoted "B" in FIG. 12, greater than the thickness of the central web portion of matching ring 92. In the presently preferred practice of the invention, the dimension B is controlled at 0.130 inches (3.3 millimeters), the exact dimensions being chosen for convenience in conjunction with a dimension to be hereinafter described on latching ring 94.

The lower latching ring 94 has a plurality, and preferably four, radially extending lugs 108 provided thereon in a circumferentially spaced relationship with the number of lugs corresponding to the number of lugs on upper latching ring 92. The lugs 110 extend upwardly beyond the upper surface of the central portion of ring 94 to have a predetermined axial thickness, denoted by "A" in FIGS. 12 and 13, greater than the dimension B of the lugs on latching ring 92. In the presently preferred practice of the invention, the lugs 110 have the dimension A approximately 0.150 inches (3.8 millimeters), which amounts to a difference of 0.020 inches (5.1 millimeters) from the dimension B of the lugs 108 on the upper latching ring 92. The difference between the dimensions A and B determines the upward movement permitted the fulcrum 14 by the latching rings, as will be hereinafter described, which difference of approximately 0.020 inches (5.1 millimeters) at the fulcrum yields an increase of lash of approximately 0.030 inches (7.6 millimeters) at the cam follower for a conventional rocker arm pivoted to have a ratio of approximately 1:5.

Referring particularly to FIG. 13, the upper and lower latching rings 92, 94 are shown in nested configuration with the undersurface 112 of the central portion of ring 92 in axial registration with the upper face 114 of the lower latching ring 94, with the lugs 108 nested intermediate the lugs 110 of the lower ring 94.

Referring to FIG. 12, the lower ring 94 has an arm 116 provided thereon circumferentially coincident with one of the lugs 110 and extending radially outwardly therefrom a suitable amount to serve as a lever for rotating the latching plates 92, 94 and has an aperture 118 provided therein for pivotal connection thereto.

Referring again to FIG. 13, the tabs 78 are shown as they would appear in the assembled position and extending through the slots 88 formed in the spring retainer and with the tabs each aligned circumferentially respectively under one of the lugs 108 of the upper latching ring 92. In operation, as the cam driving forces cause rocker arm 12 to urge fulcrum 70 in an upward direction with the latching rings in the position shown in FIG. 13, the end of tabs 78 register axially against the undersurface of lugs 108 and further upward movement of the fulcrum 70 is prevented. Thus, an additional amount of lost-motion lash is introduced in the valve gear by an amount equal to the difference between dimensions A and B, as will be hereinafter explained in detail. With the lugs 108 aligned over tab 78 as shown in FIG. 13, upon registration of the ends of tabs 78 with the undersurface of lugs 108, latching ring 92 is separated vertically from latching ring 94 by a small amount, since the reaction forces from fulcrum 70 are transmitted directly through tab 78 to the undersurface of lug 108, and from the upper surface of latching ring 92 and lug 108 to the stop plate 102.

The operation of the engine valve gear with the latching rings aligned as shown in FIG. 13 thus provide an additional amount of lost-motion lash in the valve gear determined by the differences between dimensions A and B and permits the valve gear to operate in the high level lash mode. Operation of the valve gear in the high level lash mode results in decreased duration and amount of valve opening as heretofore mentioned.

When it is desired to return the engine valve gear to the normal amount of valve lift and duration for the valve event, an actuating force is applied to aperture 118 in the lower latching ring 94. However, the latching rings are prevented from rotation until such time as there occurs relaxation of the valve gear driving forces on the rocker arm. When such relaxation occurs, the spring 74 urges fulcrum 72 downward so as to cause tab 78 to no longer be in axial registration with the undersurface of lugs 108, thus permitting the force on arm 116 to rotate the latch rings together to a position in which lugs 110 on the lower latching ring 94 are in circumferential alignment with the end of tab 78. The latching means of the present invention is thus moved to a second position in which the amount of lost motion lash in the valve gear is determined by the dimension A of lugs 110 on the lower latching ring. When the lugs 110 are aligned with the end of tabs 78, and upon cyclic recurrence of the valve gear driving forces, the rocker arm 12 moves fulcrum 70 upward causing the end of tab 78 to register axially against the undersurface of lugs 110 and transmit the valve gear driving forces from the upper surface of lugs 110 to the stop plate 100, and further upward motion of the fulcrum 70 is prevented. As long as the latching means is left in such a position with lugs 110 of the lower latching ring aligned with the tabs 78, the engine valve gear will provide the normal amount of valve lift and duration of the valve event. If desired, the latching means may be returned to the position illustrated in FIG. 13 by reversing the direction of force applied to arm 116 and rotating the latching rings to vertically align lugs 108 and tabs 78.

FIG. 11 illustrates the preferred practice of the invention in which the mounting bracket 106 extends between a pair of adjacent mounting studs 16 for the valves of a single combustion chamber. The bracket has mounted thereon a suitable actuator 122 as, for example, an electrical solenoid with the armature 124 thereof connected to a suitable linkage 126 pivotally attached to the aperture 118 of arm 116 in one of the lower spacer rings 94 of the latching means. A rod 120 interconnects the arms 116 of the latching means for the intake and exhaust valve of a single combustion chamber.

Figure 1:
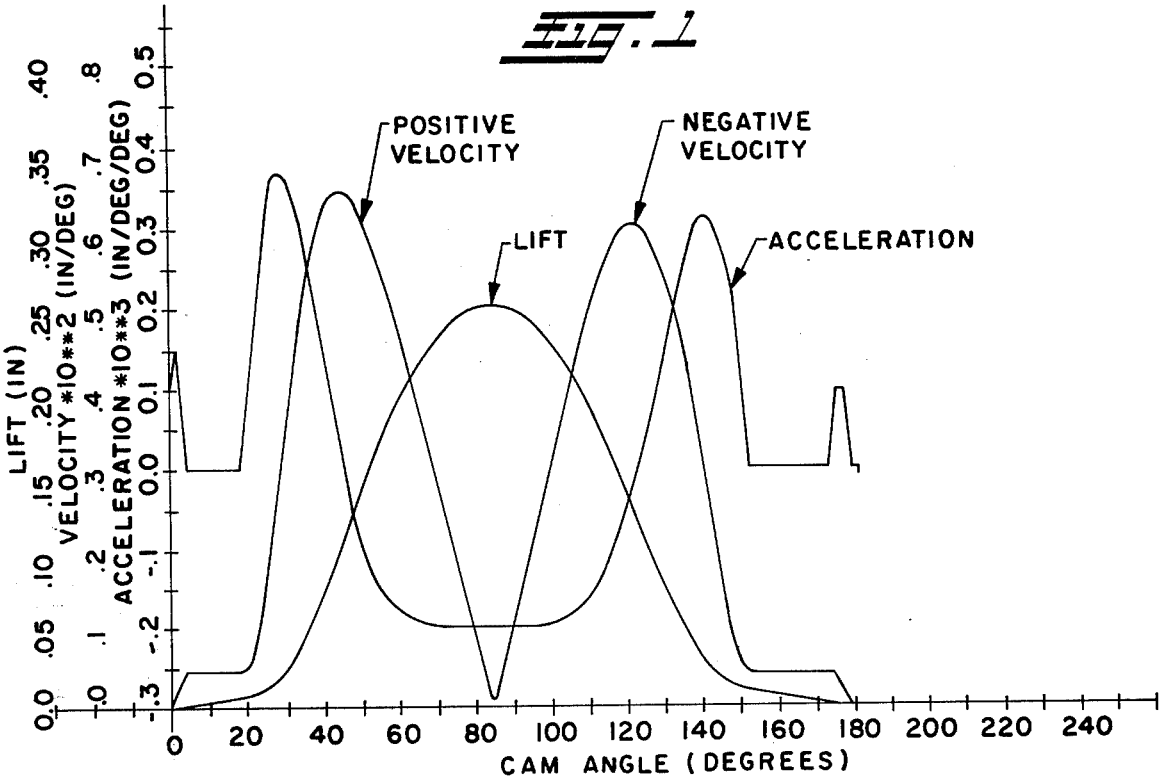
FIG. 1 is a graphical presentation of the lift, velocity and acceleration of cam follower of a conventional automotive internal combustion engine.
Figure 2:
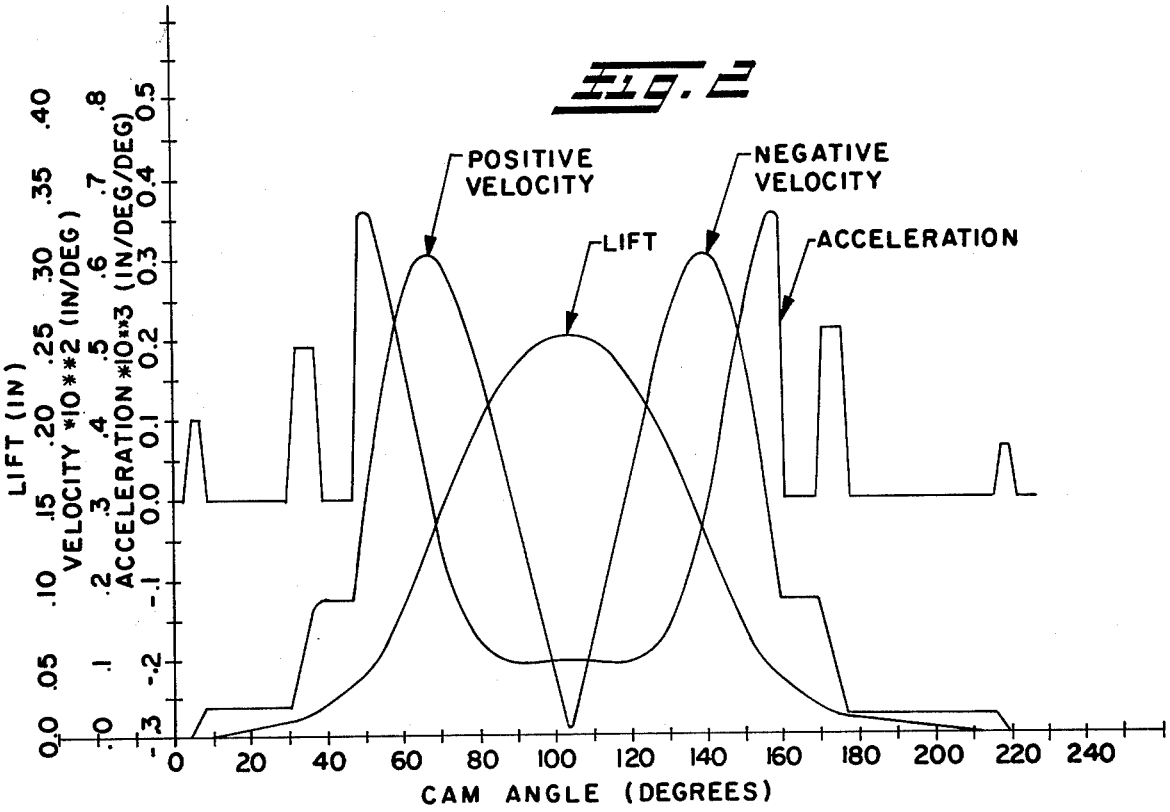
FIG. 2 is a graphical presentation similar to FIG. 1 showing the lift, velocity and acceleration of cam follower for valve gear employing the present invention.

Referring now to FIGS. 1 and 2, the valve lift, velocity and acceleration, measured at the cam follower, are illustrated graphically in FIG. 1 for a conventional automotive camshaft lobe profile. It will be observed from FIG. 1 that, upon onset of valve lift, the lift increases at a high velocity which continues until the cam has rotated to nearly the full lift position. From FIG. 1 it will be seen that, at a displacement of approximately 0.030 inches (0.76 millimeters) at the cam follower, which occurs at the cam angle in the region 30° to 35°, nearly maximum lift velocity is occurring. If the latching means of the present invention were to be rotated for changing the amount of lash in the valve gear with the cam profile of FIG. 1, the high velocity occurring at the corresponding cam angle for the additional lash would result in clashing of the valve gear components and high velocity seating of the valve upon closing.

Referring now to FIG. 2 the cam follower lift, velocity and accelerations are shown plotted as a function of cam angle rotation in degrees with the lift in inches measured at the cam follower. From FIG. 2 it is seen that, in the region of 0.030 inches (0.76 millimeters), cam follower lift or lash take up, the corresponding cam angle of rotation produces a substantially constant velocity having a value substantially less than the corresponding value of the velocity which would result if the cam profile of FIG. 1 were employed. In the presently preferred practice of the invention a typical cam profile in accordance with FIG. 2 produces constant velocities in the region for cam rotation through an angle of 38° to 48° which, it will be seen from FIG. 2, corresponds to a lift or lash in the amount of 0.030 inches (0.76 millimeters). Thus, lash take-up occurs at a relatively low velocity, and corresponding seating of the valve occurs at a similar low velocity if the cam is configured nearly symmetrically as in FIG. 2.

The present invention thus provides a unique cam profile which yields a low level substantially constant velocity of follower lift at lash take-up where it is desired to selectively provide an additional amount of lash in the valve gear equivalent to the lift in the region of constant velocity. The cam profile of the present invention thus permits the valve gear to be altered selectively while the engine is running to incorporate a substantially greater amount of lost-motion lash for the purpose of reducing the valve lift and duration of valve opening to enable more economical operation of the engine at idle and low speeds. The means for selectively changing the valve gear lash while the engine is running incorporates a two-position rotatable latching mechanism which changes position upon relaxation of the valve gear forces when urged by application of an external actuating force. The application of the actuating force produces movement of the latching mechanism only during periods when the cyclic valve gear driving forces are relaxed. The present invention thus provides a unique method of operating an internal combustion engine wherein the engine may be selectively operated in different modes of valve lift and valve event duration depending upon the requirements of engine speed without encountering clashing of valve gear components or high velocity valve seating.

Although the invention has hereinabove been described in certain preferred embodiments, it will be understood by those having ordinary skill in the art that the invention is capable of modification and variation and is limited only by the following claims.

What is claimed is:

1. In an internal combustion engine of the type having valve means for controlling flow to and from a combustion chamber, drive means for providing cyclical motion for opening and closing said valve means in timed relationship to the events in said combustion chamber, and valve gear means operative in response to said cyclic motion to effect cyclic opening and closing of said valve means, the improvement comprising:

(a) said valve gear means including, (i) two-state latchable means movable between a latched and unlatched position and operative in said latched position to provide a first stage predetermined lash and effect normal predetermined cyclic opening and closing of said valve means, said two-state means in unlatched position being operable to effect lost motion of said drive means and provide a predetermined second stage lash substantially greater than said first stage lash for effecting cyclic opening and closing of said valve means by a predetermined amount less than said normal predetermined opening and closing and, (ii) contact means for contacting said drive means and following said cyclical motion;

(b) said drive means including cam means operative during said cyclic motion to impart to said valve train means movement increasing rapidly from zero to a maximum and decreasing rapidly again to zero, said cam means being operative to provide, during said increasing motion, a predetermined period wherein said motion increases at a predetermined substantially linear rate yielding substantially constant and lower velocity of said drive train means during said predetermined period, said cam means being operative such that, when said latchable means is in said latched position, termination of said second stage lash occurs during said predetermined period of linear rate motion increase, thereby preventing damage to said valve gear means;

(c) means operative while the engine is running to move said latchable means between the latched and unlatched position for changing from said valve gear from first stage to said second stage lash for operating the engine in a selected mode of increased or decreased opening of said valve means.

2. A device usable in an internal combustion engine of the type having valve means for controlling flow to and from a combustion chamber, drive means for providing cyclic motion in timed relationship to events in said combustion chamber and valve train means responsive to said cyclic motion and operative to effect opening and closing of said valve means in a predetermined manner, said device being operative for selectably changing while running, the amount of opening and closing of the combustion chamber valves, said device comprising:

(a) two-stage latchable means movable between a latched position to provide a predetermined first stage lost motion lash in said valve train means for effecting predetermined normal amount of opening and closing of said valve means, said latchable means being movable between a latched and unlatched position, said latchable means being operative in said unlatched position to provide a predetermined first stage lash in said valve train means for effecting predetermined normal opening and closing of said valve means, said two-stage means being operable in said latched position to provide a predetermined second stage lost motion lash in said valve train means for effecting a second predetermined amount less than said normal amount of opening and closing of said valve means;

(b) said drive means including cam means operative during said cyclic motion to impart to said valve train means movement rapidly increasing from zero to a maximum and decreasing rapidly again to zero, said cam means being operative to provide, during said increasing motion, a predetermined period wherein said motion increases a predetermined substantially linear rate yielding substantially constant and lower velocity of said drive train means during said predetermined period, said cam means being operative such that, when said two-stage means is in said latched position, termination of said second stage lost motion lash occurs during said predetermined period of linear rate motion increase, thereby preventing damage to said valve train means and said valve means; and, (c) means operative while the engine is running to move said latchable means between the latched and unlatched position for changing between said first stage and said second stage lash for operating the engine in a selected mode of normal or decreased opening of said valve means.

3. A device, usable with the valve gear of the type opening and closing the combustion chamber valves of an internal combustion engine, for selecting, while the engine is running, one of a plurality of predetermined valves of lost-motion lash in the valve gear for altering the amount and timing of opening and closing of the combustion chamber valves; said device comprising:

(a) reaction means adapted to be contacted by driving portions of the valve gear during cyclic movement thereof and operative to transmit said valve driving forces to other portions of said valve gear;

(b) mounting means adapted for attachment of said reaction means to the engine, said mounting means including a mounting member having said reaction means movably mounted thereon;

(c) latchable means movable between a first unlatched position operative to provide a low lost-motion lash movement of said reaction means with respect to said mounting member and a second latched position operative to provide second lost motion lash movement substantially greater than said low lash movement, said latchable means including means rotatable with respect to said mounting member, said rotatable means including means defining a first and second registration surfaces spaced apart by a predetermined amount corresponding to said low lash when said latchable means is in said first position with said valve gear driving forces relaxed, said first and second registration surfaces being in driving contact when said driving forces are applied, and said latchable means including means defining a third registration surface spaced from said first surface by a predetermined amount corresponding to said high lash when said latchable means is in said second position with said valve gear driving forces relaxed, said first and third registration surfaces being in driving contact when said driving forces are applied;

(c) means biasing said second and third registration surfaces away from said first surface; and, (d) means operative to apply an actuating and deactuating forces to said latchable means for movement between said latched and unlatched positions; said force applying means being operative to move said latchable means when said valve gear driving forces are relaxed and said force applying means being unable to move said latchable means when said valve gear driving forces are applied.

4. An improved method of efficiently operating an internal combustion engine having combustion chamber valve gear actuated by a rotary cam means and cam follower means and having a predetermined lost-motion lash during cyclic movement of said cam means comprising the steps of:

(a) selectively changing, while the engine is running, lash of said valve gear between a first stage normal amount and second stage amount substantially greater than said normal amount, and reducing from the first stage the amount of valve lift and valve event duration in said second lash stage; and, (b) profiling said cam means to provide a substantially constant velocity during take-up of said second stage lash and subsequent valve seating during the same valve event, said substantially constant velocity being substantially lower than the corresponding first stage velocity for lash take-up and valve seating.

* * * * *